US009133684B2

(12) United States Patent
Hofman et al.

(10) Patent No.: US 9,133,684 B2
(45) Date of Patent: Sep. 15, 2015

(54) DOWNHOLE TOOL

(76) Inventors: Raymond Hofman, Midland, TX (US); William Sloane Muscroft, Midland, TX (US)

( * ) Notice: Subject to any disclaimer, the term of this patent is extended or adjusted under 35 U.S.C. 154(b) by 153 days.

(21) Appl. No.: 13/462,810

(22) Filed: May 2, 2012

(65) Prior Publication Data

US 2012/0279723 A1 Nov. 8, 2012

Related U.S. Application Data

(60) Provisional application No. 61/481,483, filed on May 2, 2011.

(51) Int. Cl.

*E21B 34/10* (2006.01)
*E21B 34/06* (2006.01)
*E21B 34/00* (2006.01)

(52) U.S. Cl.

CPC ..... *E21B 34/063* (2013.01); *E21B 34/102* (2013.01); *E21B 34/103* (2013.01); *E21B 2034/007* (2013.01)

(58) Field of Classification Search

CPC ... E21B 34/063; E21B 34/102; E21B 34/103; E21B 21/103; E21B 2034/007; E21B 33/146
USPC ..... 166/373, 374, 376, 317, 319, 332.1, 166/323
See application file for complete search history.

(56) References Cited

U.S. PATENT DOCUMENTS 2,251,977 A * 8/1941 Burt ..... 166/156
4,429,747 A * 2/1984 Williamson, Jr. ..... 166/321
4,515,217 A * 5/1985 Stout ..... 166/297
4,771,831 A * 9/1988 Pringle et al. ..... 166/319
5,048,611 A * 9/1991 Cochran ..... 166/374
5,261,486 A * 11/1993 Cornette et al. ..... 166/51
6,293,342 B1 * 9/2001 McGarian et al. ..... 166/317
6,464,008 B1 * 10/2002 Roddy et al. ..... 166/285
7,861,788 B2 * 1/2011 Tips et al. ..... 166/319
7,866,402 B2 * 1/2011 Williamson, Jr. ..... 166/374
7,909,095 B2 * 3/2011 Richards et al. ..... 166/250.08
7,926,573 B2 * 4/2011 Swan et al. ..... 166/374
8,096,363 B2 * 1/2012 Williamson, Jr. ..... 166/319
8,267,178 B1 * 9/2012 Sommers et al. ..... 166/334.4
8,567,509 B1 * 10/2013 Kippola et al. ..... 166/373
2002/0121373 A1 * 9/2002 Patel ..... 166/250.08
2002/0166665 A1 * 11/2002 Vincent et al. ..... 166/291
2005/0072575 A1 * 4/2005 Yeo et al. ..... 166/374
2008/0302538 A1 * 12/2008 Hofman ..... 166/373
2009/0095463 A1 * 4/2009 Swan et al. ..... 166/53
2009/0095486 A1 * 4/2009 Williamson, Jr. ..... 166/373
2010/0314562 A1 * 12/2010 Bisset ..... 251/12
2011/0174491 A1 * 7/2011 Ravensbergen et al. ... 166/308.1
2013/0056220 A1 * 3/2013 Sommers et al. ..... 166/373

* cited by examiner

*Primary Examiner* — Blake Michener

(57) ABSTRACT

A downhole tool comprising an inner sleeve with a plurality of sleeve ports and a housing positioned radially outwardly of the inner sleeve and having a plurality of housing ports, with the housing and inner sleeve partially defining a space radially therebetween. The space is occupied by a shifting sleeve. A fluid path extends between the interior flowpath of the tool and the space. A fluid control device, occupies at least portion of the fluid path, and may selectively permit fluid flow, and thus pressure communication, into the space to cause a differential pressure across the shifting sleeve. When a sufficient differential pressure is reached, the shifting sleeve is moved from a first position to a second position, which opens the communication paths through the housing and sleeve ports between the interior flowpath and exterior of the tool.

26 Claims, 7 Drawing Sheets

DOWNHOLE TOOL

CROSS-REFERENCES TO RELATED APPLICATIONS

This application claims the benefit of U.S. provisional application Ser. No. 61/481,483, filed May 2, 2011 and entitled "Downhole Tool," which is incorporated by reference herein.

STATEMENT REGARDING FEDERALLY SPONSORED RESEARCH OR DEVELOPMENT

Not applicable.

BACKGROUND

1. Field of the Invention

The described embodiments and invention as claimed relate to oil and natural gas production. More specifically, the invention as claimed relates to a downhole tool used to selectively activate in response to fluid pressure.

2. Description of the Related Art

In completion of oil and gas wells, tubing is often inserted into the well to function as a flow path for treating fluids into the well and for production of hydrocarbons from the well. Such tubing may help preserve casing integrity, optimize production, or serve other purposes. Such tubing may be described or labeled as casing, production tubing, liners, tubulars, or other terms. The term "tubing" as used in this disclosure and the claims is not limited to any particular type, shape, size or installation of tubular goods.

To fulfill these purposes, the tubing must maintain structural integrity against the pressures and pressure cycles it will encounter during its functional life. To test this integrity, operators will install the tubing with a closed "toe"—the end of the tubing furthest from the wellhead—and then subject the tubing to a series of pressure tests. These tests are designed to demonstrate whether the tubing will hold the pressures for which it was designed.

One detriment to these pressure tests is the necessity for a closed toe. After pressure testing, the toe must be opened to allow for free flow of fluids through the tubing so that further operations may take place. While formation characteristics, cement, or other factors may still restrict fluid flow, the presence of such factors do not alleviate the desirability or necessity for opening the toe of the tubing. Commonly, the toe is opened by positioning a perforating device in the toe and either explosively or abrasively perforating the tubing to create one or more openings. Perforating, however, requires additional time and equipment that increase the cost of the well. Therefore, there exists a need for an improved method of opening the toe of the tubing after it is installed and pressure tested.

The present disclosure describes an improved device and method for opening the toe of tubing installed in a well. Further, the device and method may be readily adapted to other well applications as well.

SUMMARY OF PREFERRED EMBODIMENTS

The described embodiments of the present disclosure address the problems associated with the closed toe required for pressure testing tubing installed in a well. Further, in one aspect of the present disclosure, a chamber, such as a pressure chamber, air chamber, or atmospheric chamber, is in fluid communication with at least one surface of the shifting element of the device. The chamber is isolated from the interior of the tubing such that fluid pressure inside the tubing is not transferred to the chamber. A second surface of the shifting sleeve is in fluid communication with the interior of the tubing. Application of fluid pressure on the interior of the tubing thereby creates a pressure differential across the shifting element, applying force tending to shift the shifting element in the direction of the pressure chamber, atmospheric chamber, or air chamber.

In a further aspect of the present disclosure, the shifting sleeve is encased in an enclosure such that all surfaces of the shifting element opposing the chamber are isolated from the fluid, and fluid pressure, in the interior of the tubing. Upon occurrence of some predetermined event—such as a minimum fluid pressure, the presence of acid, or electromagnetic signal—at least one surface of the shifting element is exposed to the fluid pressure from the interior of the tubing, creating differential pressure across the shifting sleeve. Specifically, the pressure differential is created relative to the pressure in the chamber, and applies a force on the shifting element in a desired direction. Such force activates the tool.

While specific predetermined events are stated above, any event or signal communicable to the device may be used to expose at least one surface of the shifting element to pressure from the interior of the tubing.

In a further aspect, the downhole tool comprises an inner sleeve with a plurality of sleeve ports. A housing is positioned radially outwardly of the inner sleeve, with the housing and inner sleeve partially defining a space radially therebetween. The space, which is preferably annular, is occupied by a shifting element, which may be a shifting sleeve. A fluid path extends between the interior flowpath of the tool and the space. A fluid control device, which is preferably a burst disk, occupies at least portion of the fluid path.

When the toe is closed, the shifting sleeve is in a first position between the housing ports and the sleeve ports to prevent fluid flow between the interior flowpath and exterior of the tool. A control member is installed to prevent or limit movement of the shifting sleeve until a predetermined internal tubing pressure or internal flowpath pressure is reached. Such member may be a fluid control device which selectively permits fluid flow, and thus pressure communication, into the annular space to cause a differential pressure across the shifting sleeve. Any device, including, without limitation, shear pins, springs, and seals, may be used provided such device allows movement of the shifting element, such as shifting sleeve, only after a predetermined internal tubing pressure or other predetermined event occurs. In a preferred embodiment, the fluid control device will permit fluid flow into the annular space only after it is exposed to a predetermined differential pressure. When this differential pressure is reached, the fluid control device allows fluid flow, the shifting sleeve is moved to a second position, the toe is opened, and communication may occur through the housing and sleeve ports between the interior flowpath and exterior flowpath of the tool.

DETAILED DESCRIPTION OF A PREFERRED EMBODIMENT

When used with reference to the figures, unless otherwise specified, the terms "upwell," "above," "top," "upper," "downwell," "below," "bottom," "lower," and like terms are used relative to the direction of normal production and/or flow of fluids and or gas through the tool and wellbore. Thus, normal production results in migration through the wellbore and production string from the downwell to upwell direction without regard to whether the tubing string is disposed in a vertical wellbore, a horizontal wellbore, or some combination of both. Similarly, during the fracing process, fracing fluids and/or gasses move from the surface in the downwell direction to the portion of the tubing string within the formation.

Figure 1:
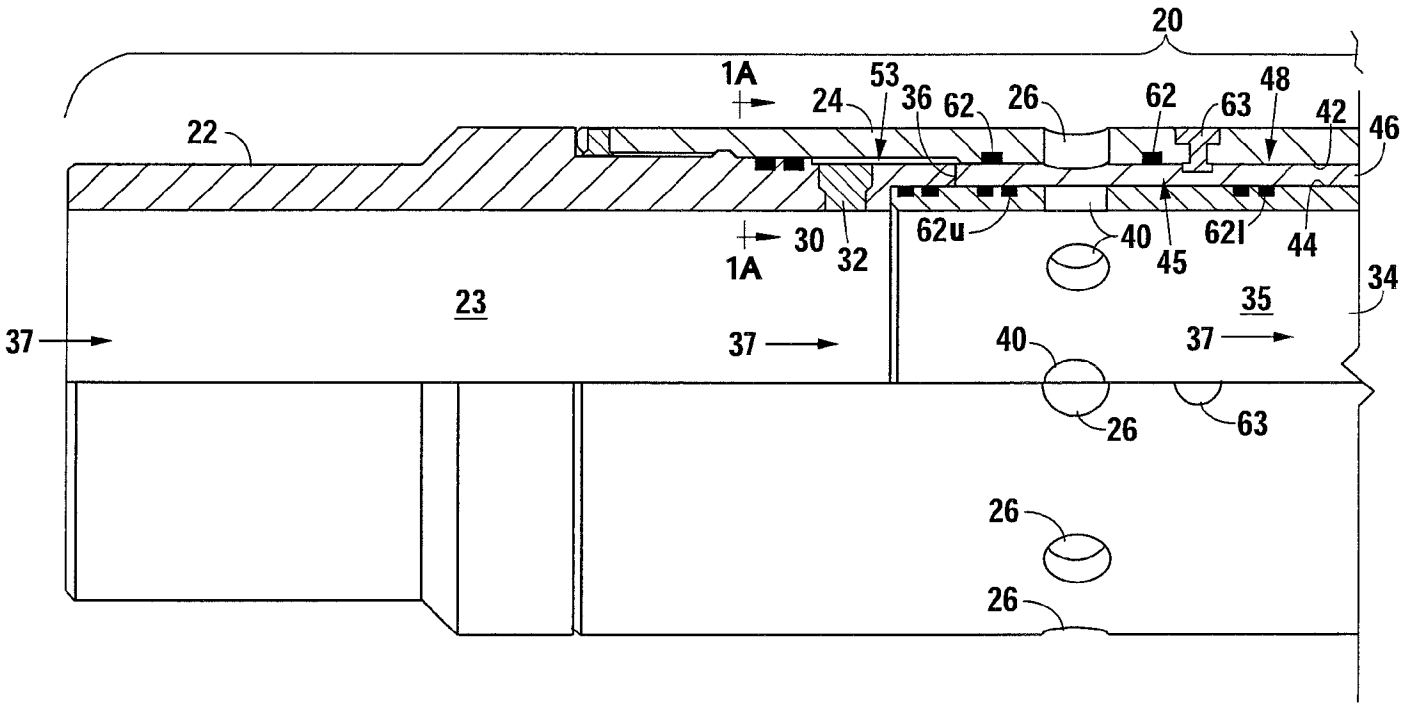
FIGS. 1-2 are partial sectional side elevations of a preferred embodiment in the closed position.
Figure 1A:
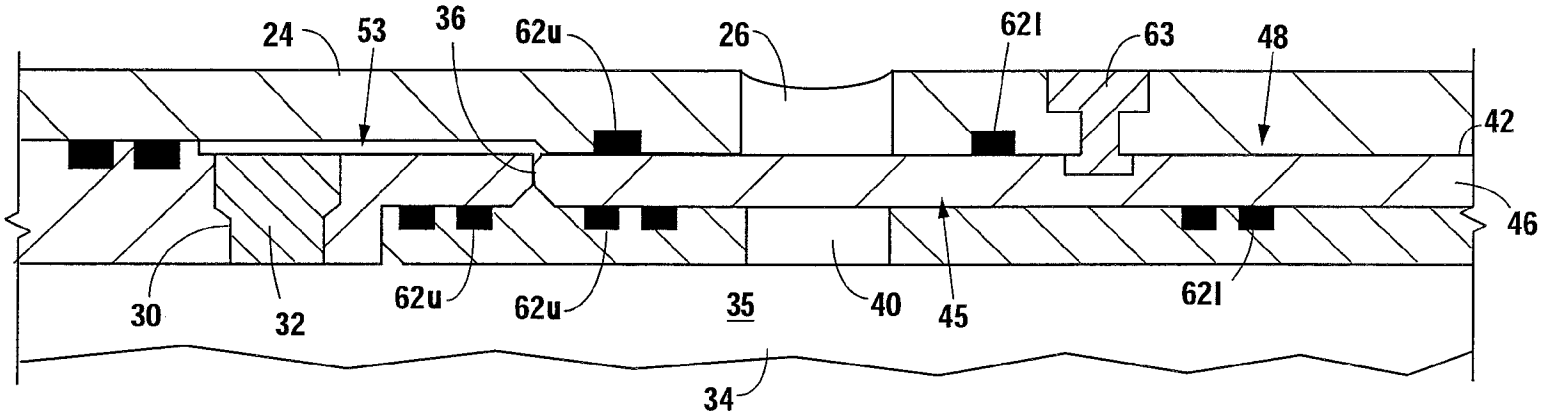
FIGS. 1A & 2A are enlarged views of windows 1A and 2A of FIGS. 1 & 2 respectively.
Figure 2:
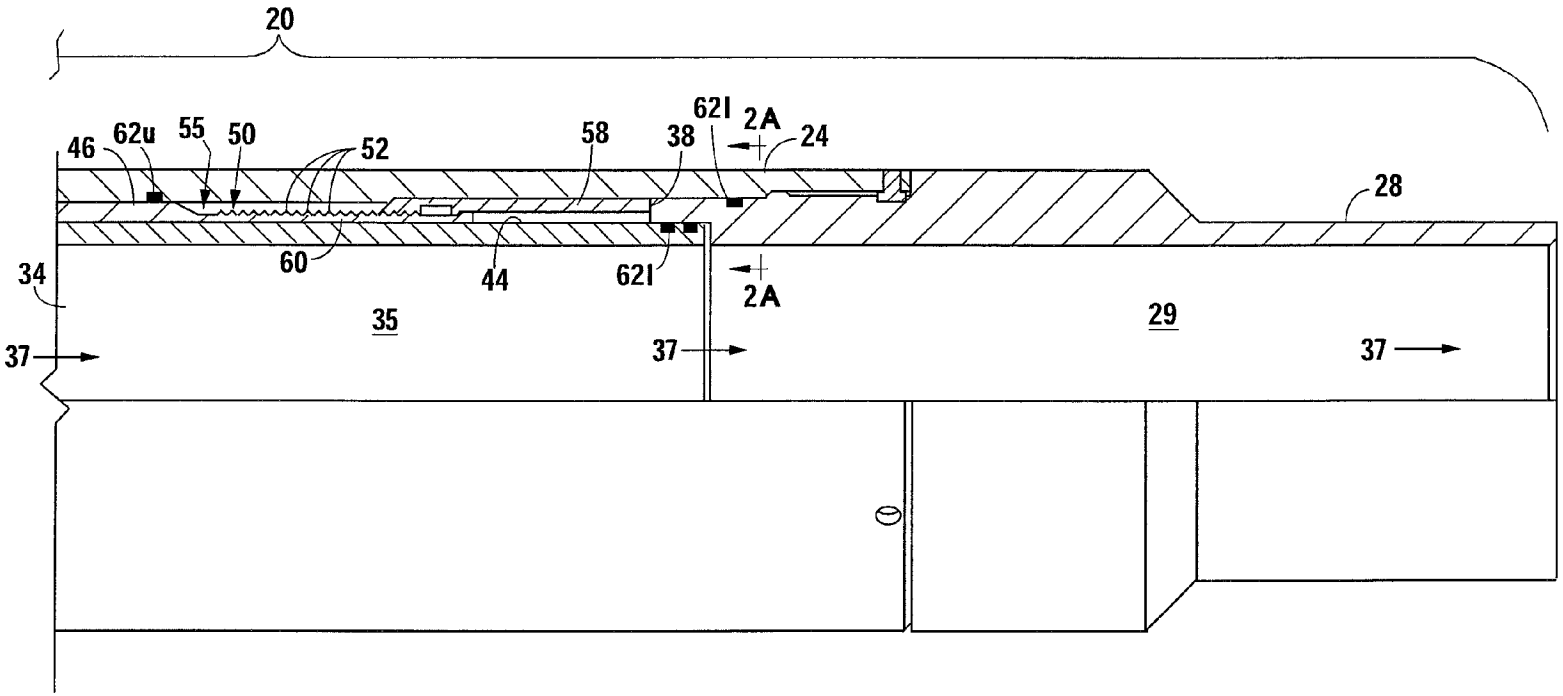
Figure 2A:
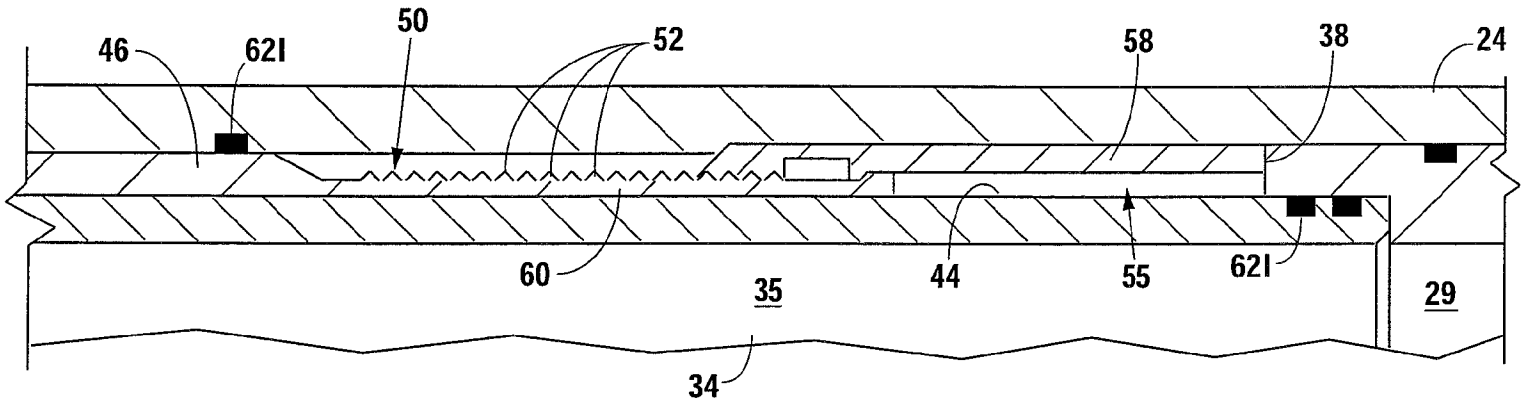

FIGS. 1-2 depict a preferred embodiment 20, which comprises a top connection 22 threaded to a top end of ported housing 24 having a plurality of radially-aligned housing ports 26. A bottom connection 28 is threaded to the bottom end of the ported housing 24. The top and bottom connections 22, 28 having cylindrical inner surfaces 23, 29, respectively. A fluid path 30 through the wall of the top connection 22 is filled with a burst disk 32 that will rupture when a pressure is applied to the interior of the tool 22 that exceeds a rated pressure.

An inner sleeve 34 having a cylindrical inner surface 35 is positioned between a lower annular surface 36 of the top connection 22 and an upper annular surface 38 of the bottom connection 28. The inner sleeve 34 has a plurality of radially aligned sleeve ports 40. Each of the sleeve ports 40 is concentrically aligned with a corresponding housing port 26. The inner surfaces 23, 29 of the top and bottom connections 22, 28 and the inner surface 35 of the sleeve 35 define an interior flowpath 37 for the movement of fluids into, out of, and through the tool. In an alternative embodiment, the interior flowpath may be defined, in whole or in part, by the inner surface of the shifting sleeve.

Although the housing ports 26 and sleeve ports 40 are shown as cylindrical channels between the exterior and interior of the tool 20, the ports 26, 40 may be of any shape sufficient to facilitate the flow of fluid therethrough for the specific application of the tool. For example, larger ports may be used to increase flow volumes, while smaller ports may be used to reduce cement contact in cemented applications. Moreover, while preferably concentrically aligned, each of the sleeve ports 40 need not be concentrically aligned with its corresponding housing port 26.

The top connection 22, the bottom connection 28, an interior surface 42 of the ported housing 24, and an exterior surface 44 of the inner sleeve 34 define an annular space 45, which is partially occupied by a shifting sleeve 46 having an upper portion 48 and a lower locking portion 50 having a plurality of radially-outwardly oriented locking dogs 52.

The annular space 45 comprises an upper pressure chamber 53 defined by the top connection 22, burst disk 32, outer housing 24, inner sleeve 34, the shifting sleeve 46, and upper sealing elements 62*u*. The annular space 45 further comprises a lower pressure chamber 55 defined by the bottom connection 28, the outer housing 24, the inner sleeve 34, the shifting sleeve 46, and lower sealing elements 62*l*. In a preferred embodiment, the pressure within the upper and lower pressure chambers 53, 55 is atmospheric when the tool is installed in a well (i.e., the burst disk 32 is intact).

A locking member 58 partially occupies the annular space 45 below the shifting sleeve 46 and ported housing 24. When the sleeve is shifted, the locking dogs 52 engage the locking member 58 and inhibit movement of the shifting sleeve 46 toward the shifting sleeve's first position.

The shifting sleeve 46 is moveable within the annular space 45 between a first position and a second position by application of hydraulic pressure to the tool 20. When the shifting sleeve 46 is in the first position, which is shown in FIGS. 1-2, fluid flow from the interior to the exterior of the tool through the housing ports 26 and sleeve ports 40 is impeded by the shifting sleeve 46 and surrounding sealing elements 62. Shear pins 63 may extend through the ported housing 24 and engage the shifting sleeve 46 to prevent unintended movement toward the second position thereof, such as during installation of the tool 20 into the well. Although shear pins 63 function in such a manner as a secondary safety device, alternative embodiments contemplate operation without the presence of the shear pins 63. For example, the downhole tool may be installed with the lower pressure chamber containing fluid at a higher pressure than the upper pressure chamber, which would tend to move and hold the shifting sleeve in the direction of the upper pressure chamber.

To shift the sleeve 46 to the second position (shown in FIG. 3-4), a pressure greater than the rated pressure of the burst disk 32 is applied to the interior of the tool 20, which may be done using conventional techniques known in the art. This causes the burst disk 32 to rupture and allows fluid to flow through the fluid path 30 to the annular space 45. In some embodiments, the pressure rating of the burst disk 32 may be lowered by subjecting the burst disk 32 to multiple pressure cycles. Thus, the burst disk 32 may ultimately be ruptured by a pressure which is lower than the burst disk's 32 initial pressure rating.

Figure 3:
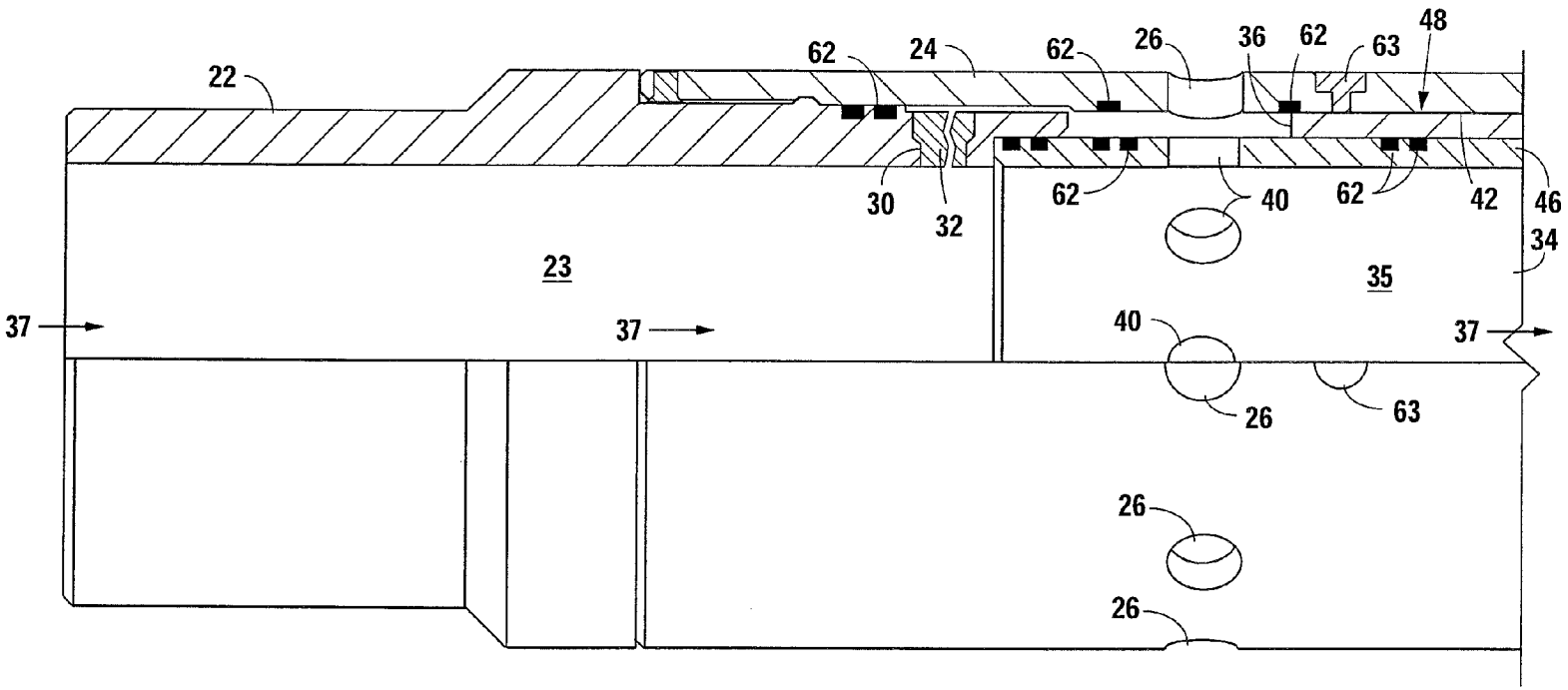
FIGS. 3-4 are partial sectional side elevations of the preferred embodiment in the open position.
Figure 4:
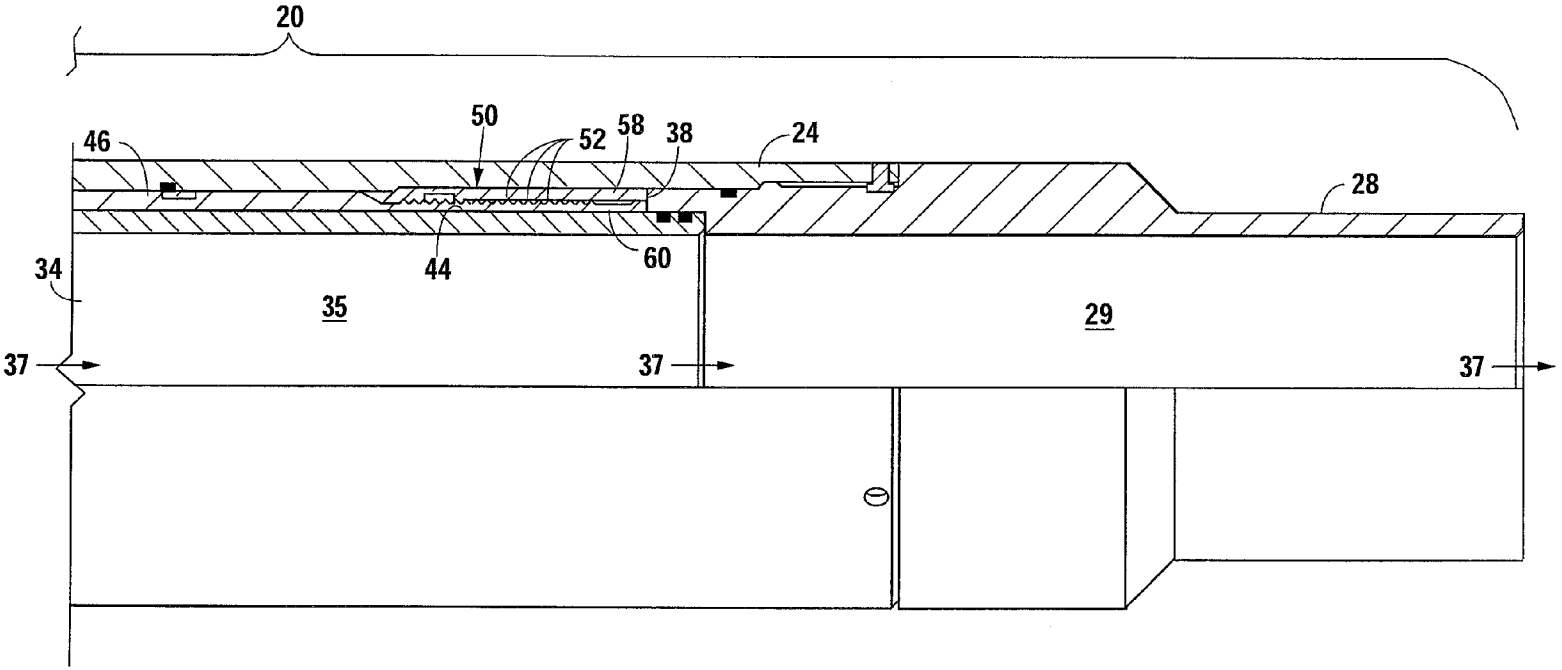

Following rupture of the burst disk 32, the shifting sleeve 46 is no longer isolated from the fluid flowing through the inner sleeve 34. The resultant increased pressure on the shifting sleeve surfaces in fluid communication with the upper pressure chamber 53 creates a pressure differential relative to the atmospheric pressure within the lower pressure chamber 55. Such pressure differential across the shifting sleeve causes the shifting sleeve 36 to move from the first position to the second position shown in FIG. 3-4, provided the force applied from the pressure differential is sufficient to overcome the shear pins 63, if present. In the second position, the shifting sleeve 46 does not impede fluid flow through the housing ports 26 and sleeve ports 40, thus allowing fluid flow between the interior flow path and the exterior of the tool. As the shifting sleeve 46 moves to the second position, the locking member 58 engages the locking dogs 52 to prevent subsequent upwell movement of the sleeve 46.

Figure 5:
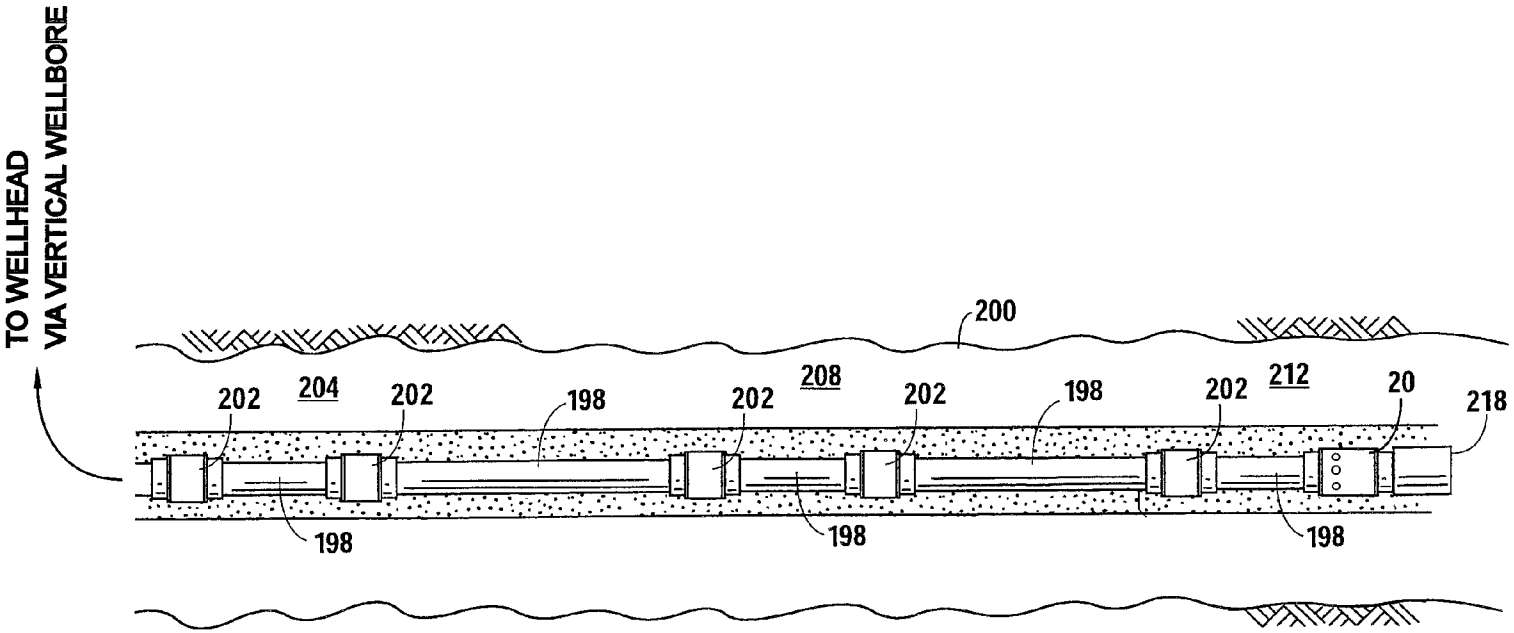
FIG. 5 is a side sectional elevation of a system incorporating an embodiment of the downhole tool described with reference to FIGS. 1-4.

FIG. 5 shows the embodiment described with reference to FIGS. 1-4 in use with tubing 198 disposed into a lateral extending through a portion of a hydrocarbon producing formation 200, with the tubing 198 having various downhole devices 202 positioned at various stages 204, 208, 212 thereof. The tubing 198 terminates with a downhole tool 20 having the features described with reference to FIGS. 1-4 and a plugging member 218 (e.g., bridge plug) designed to isolate flow of fluid through the end of the tubing 198. Initially, the tool 20 is in the state described with reference to FIGS. 1-2.

Prior to using the tubing 198, the well operator may undertake a number of integrity tests by cycling and monitoring the pressure within the tubing 198 and ensuring pressure loss is within acceptable tolerances. This, however, can only be done if the downwell end of the tubing 198 is isolated from the surrounding formation 200 with the isolation member 218 closing off the toe of the tubing 198. After testing is complete, the tool 20 may be actuated as described with reference to FIGS. 3-4 to open the toe end of tubing 198 to the flow of fluids.

The downhole tool may be placed in positions other than the toe of the tubing, provided that sufficient internal flowpath pressure can be applied at a desired point in time to create the necessary pressure differential on the shifting sleeve. In certain embodiments, the internal flowpath pressure must be sufficient to rupture the burst disk, shear the shear pin, or otherwise overcome a pressure sensitive control element. However, other control devices not responsive to pressure may be desirable for the present device when not installed in the toe.

The downhole tool as described may be adapted to activate tools associated with the tubing rather than to open a flow path from the interior to the exterior of the tubing. Such associated tools may include a mechanical or electrical device which signals or otherwise indicates that the burst disk or other flow control device has been breached. Such a device may be useful to indicate the pressures a tubing string experiences at a particular point or points along its length. In other embodiments, the device may, when activated, trigger release of one section of tubing from the adjacent section of tubing or tool. For example, the shifting element may be configured to mechanically release a latch holding two sections of tubing together. Any other tool may be used in conjunction with, or as part of, the tool of the present disclosure provided that the inner member selectively moves within the space in response to fluid flow through the flowpath 30. Numerous such alternate uses will be readily apparent to those who design and use tools for oil and gas wells.

The illustrative embodiments are described with the shifting sleeve's first position being "upwell" or closer to the wellhead in relation to the shifting sleeve's second position, the downhole tool could readily be rotated such that the shifting sleeve's first position is "downwell" or further from the wellhead in relation to the shifting sleeve's second position. In addition, the illustrative embodiments provide possible locations for the flow path, fluid control device, shear pin, inner member, and other structures, those or ordinary skill in the art will appreciate that the components of the embodiments, when present, may be placed at any operable location in the downhole tool.

The present disclosure includes preferred or illustrative embodiments in which specific tools are described. Alternative embodiments of such tools can be used in carrying out the invention as claimed and such alternative embodiments are limited only by the claims themselves. Other aspects and advantages of the present invention may be obtained from a study of this disclosure and the drawings, along with the appended claims.

We claim:

1. A downhole tool having an interior defining an interior flowpath and an exterior, the downhole tool comprising:

an inner sleeve;

a housing positioned outwardly of said inner sleeve;

a shifting sleeve between the housing and the inner sleeve, said shifting sleeve having a first position and a second position;

a first pressure chamber defined, at least in part, by the housing, inner sleeve, and a first end of the shifting sleeve, the first pressure chamber in fluid isolation from the interior flowpath and the exterior of the downhole tool;

a second pressure chamber defined, at least in part, by the housing, inner sleeve, and a second end of the shifting sleeve, the second pressure chamber in fluid isolation from the first pressure chamber, the interior flowpath and the exterior of the downhole tool; and a first control device having a first state which prevents fluid communication from the interior flowpath to the first pressure chamber and a second state which permits fluid communication from the interior flowpath to the first pressure chamber;

wherein the shifting sleeve moves from the first position to the second position in response to the first control device changing from the first state to the second state.

2. The downhole tool of claim 1 further comprising a top connection having a first surface partially defining the first pressure chamber.

3. The downhole tool of claim 1 further comprising a bottom connection having a second surface partially defining the second pressure chamber.

4. The downhole tool of claim 1 wherein the first control device is responsive to fluid pressure greater than the pressure required to apply a force necessary to move the shifting sleeve from the first position to the second position.

5. The downhole tool of claim 1 further comprising a secondary control element wherein said secondary control element prevents movement of the shifting sleeve while the first control device is in the closed state.

6. The downhole tool of claim 1 wherein said first control device comprises a burst disk.

7. The downhole tool of claim 1 wherein the fluid control device comprises a burst disk and an end of said burst disk is substantially flush with a surface defining the interior flowpath.

8. A system comprising a tubing string, said tubing string having a device therealong and a closeable end;

said device comprising;

an enclosure at least partially defining an interior flowpath;

a plurality of ports connecting the interior flowpath to the exterior of the tubing string;

a shifting sleeve mounted within the enclosure, the shifting sleeve preventing fluid communication between the interior flowpath and the exterior of tubing string through the plurality of ports;

the shifting sleeve having a first end in fluid isolation from the interior flowpath and from the exterior of the tubing string and a second end in fluid isolation from the first end;

wherein said enclosure selectively permits fluid communication from the interior flowpath to to the first end above a first interior flowpath pressure; and the minimum force required to move the shifting sleeve from the first position to the second position equates with a second fluid pressure applied to the first end of the shifting sleeve, said second fluid pressure being lower than the first fluid pressure, the device further comprising a second pressure chamber in fluid communication with the second end of the shifting sleeve, said second pressure chamber in fluid isolation from the interior flowpath, the exterior of the device, and the first pressure chamber.

9. The system of claim 8 wherein said enclosure further comprises an enclosure flow path and a fluid control device, wherein said fluid control device is positioned in the enclosure flow path, the fluid control device preventing said fluid communication between the interior flowpath and the first end below said first interior flowpath pressure.

10. The system of claim 8, said enclosure comprising a burst disk.

11. The system of claim 8, said device further comprising a secondary safety element.

12. The system of claim 8, said device further comprising a locking member wherein said locking member is engageable with said shifting sleeve when the shifting sleeve is in the second position.

13. A system comprising a tubing string with a device placed therealong, said tubing string having a closeable end, said device comprising:

an outer housing adjacent to the closed end, said housing having at least one port therethrough;

at least one shifting sleeve mounted within the tubing, said shifting sleeve having a first position and a second position;

a first pressure chamber in fluid communication with said at least one shifting sleeve and isolated from the interior flowpath by a fluid control device;

wherein, in the first position, the shifting sleeve prevents fluid communication through the at least one port from an interior flowpath to the exterior of the tubing and, in the second position, the shifting sleeve allows fluid communication through said at least one port from the interior flowpath to the exterior of the tubing; and the shifting sleeve is moveable from the first position to the second position in response to communication of a first interior flowpath pressure to the first pressure chamber, said first interior flowpath pressure selected based on a maximum fluid pressure anticipated to be applied in the tubing string, the device further comprising a second pressure chamber in fluid communication with the shifting sleeve, said second pressure chamber in fluid isolation from the interior flowpath, the exterior of the device, and the first pressure chamber.

14. The system of claim 13 wherein the fluid control device is a burst disk.

15. A method for treating a well, said well containing a device having an interior and an exterior, the device comprising:

an inner sleeve defining, at least in part, an interior flowpath in said tool, said interior flowpath containing a fluid;

a housing with at least one port therethrough positioned outwardly of said inner sleeve, said housing and said inner sleeve partially defining an enclosure therebetween;

a shifting member occupying at least a portion of said enclosure, said shifting member having a first position in which the shifting member prevents fluid flow through the at least one port and a second position in which the shifting member allows fluid flow through the at least one port;

the enclosure comprising a first pressure chamber defined at least in part by a first end of the shifting member and a second pressure chamber defined at least in part by a second end of the shifting member, the first end and second end each in fluid isolation from the interior flowpath, from the exterior of the device and from each other;

a fluid control device having an open state and a closed state, said closed state preventing fluid communication between the interior flowpath and the first pressure chamber;

the method comprising: changing the fluid control device from a closed state to an opened state and thereby permitting fluid communication between the interior flowpath and the pressure chamber; shifting the shifting member from the first position to the second position after the fluid control device is in an open state; and Pumping fluid from the interior flowpath to the exterior of the device.

16. The method of claim 15, wherein the fluid control device changes to the open state in response to a fluid pressure, said method further comprising increasing fluid pressure in the interior flowpath to a first maximum pressure, and increasing the fluid pressure in the interior flowpath to a second maximum pressure; wherein said first maximum pressure is below the pressure necessary to change the fluid control device from the closed state to the open state, and the second maximum pressure is above the pressure necessary to change the fluid control device from an open state to a closed state.

17. The method of claim 15 wherein the fluid control device comprises a burst disk and the changing step comprises rupturing the burst disk at the second maximum pressure.

18. The method of claim 15 wherein the device further comprises a secondary safety element to prevent premature movement of the shifting sleeve.

19. The method of claim 15 wherein the shifting member consists essentially of a single shifting sleeve.

20. The method of claim 15 wherein the shifting member consists essentially of a single shifting sleeve and the device further comprises a locking member for holding the shifting sleeve in the open position.

21. The method of claim 15 further comprising conducting a pressure test at the first maximum pressure.

22. The method of claim 21 wherein the first maximum pressure is selected based on an anticipated fracture treatment pressure.

23. A method for treating a well using a downhole tool, the method comprising flowing fluid to the downhole tool, the downhole tool comprising:

a housing having at least one housing port therethrough;

an inner sleeve having at least one sleeve port therethrough, said inner sleeve at least partially defining an interior flowpath through the downhole tool;

a shifting sleeve moveable between a first position and a second position within a space between the inner sleeve and the housing;

a fluid path from the interior of the tool to a first pressure chamber between said inner sleeve and said housing with a fluid control device positioned therein, the fluid path in fluid communication with a first end of the shifting sleeve and in fluid isolation from the interior and the exterior of the downhole tool;

a second pressure chamber in fluid communication with a second end of the shifting sleeve and in fluid isolation from the interior and the exterior of the downhole tool;

changing the fluid control device from a closed state to an opened state by applying a first fluid pressure thereto, the first fluid pressure selected in relation to a maximum pressure for flowing fluids into a formation adjacent to the downhole tool;

flowing fluid through the fluid path to the first pressure chamber;

moving the shifting sleeve to the second position in which the shifting sleeve does not prevent fluid flow from the sleeve ports to the housing ports; and flowing fluid from the interior of the downhole tool to the adjacent formation.

24. The method of claim 23 wherein the fluid control device is a burst disk.

25. A method of preparing an open hole well for treating in at least one petroleum production zone formation in which a tubing string is inserted into the open hole well and cement is pumped through the tubing string into the open hole well, the method comprising: as the tubing string is inserted into the open hole well, providing at least one sliding valve to be positioned adjacent to the toe of the production tubing;

said at least one sliding valve comprising an enclosure at least partially defining an interior of the sliding valve, the enclosure comprising an enclosure flowpath with a fluid control device therein; at least one shifting member mounted within the enclosure, the enclosure preventing fluid communication from the interior flowpath of the tubing to a first end surface of the shifting member within a first pressure chamber, the sliding valve further comprising a second pressure chamber containing a second end surface of the shifting member, said second pressure chamber in fluid isolation from the interior flowpath, the exterior of the device, and the first pressure chamber;

closing the end of the tubing string;

isolating the exterior of the sliding valve from the surface;

pressure testing the tubing string after said isolating step; then changing the fluid control device from a closed state to an open state, thereby creating fluid communication between the interior flowpath and the first surface of the shifting member;

moving the shifting member from a closed position to an open position; and flowing fluid from the interior of the sliding valve to the exterior of the sliding valve.

26. The method of claim 25 wherein the shifting member is moved from the closed position to the open position by application of fluid pressure against the first end surface of the shifting member.

* * * * *